United States Patent [19]

Barradas

[11] Patent Number: 5,000,201

[45] Date of Patent: Mar. 19, 1991

[54] HAIR CURLER ROLLER

[76] Inventor: George Barradas, 15 Riverview Ct., Greenwich, Conn. 06831

[21] Appl. No.: 549,235

[22] Filed: Jul. 9, 1990

Related U.S. Application Data

[63] Continuation of Ser. No. 361,509, Jun. 5, 1989, abandoned.

[51] Int. Cl.[5] ..... A45D 2/24

[52] U.S. Cl. ..... 132/260; 132/254; 132/250

[58] Field of Search ..... 132/245, 248, 249, 250, 132/253, 254, 255, 258, 259, 260

[56] References Cited

U.S. PATENT DOCUMENTS

| | | | |
|---|---|---|---|
| 3,905,380 | 9/1975 | Bontempi | 132/255 |
| 4,056,109 | 11/1977 | Takai | 132/255 |
| 4,192,327 | 3/1980 | Vasiliou | 132/255 |
| 4,515,171 | 5/1985 | Thibodeaux | 132/250 |
| 4,844,103 | 7/1989 | Vick et al. | 132/245 |

FOREIGN PATENT DOCUMENTS

| | | | |
|---|---|---|---|
| 2452897 | 12/1980 | France | 132/254 |
| 2032772 | 5/1980 | United Kingdom | 132/226 |

*Primary Examiner*—Gene Mancene
*Assistant Examiner*—Adriene B. Lepiane
*Attorney, Agent, or Firm*—Alfred E. Miller

[57] ABSTRACT

A hair curler roller having a flexible exterior outer sleeve and a rigid center core, and a strap for holding hair ends on the outer sleeve. The strap may be retractable into the interior of the rigid center core when not in use. A compact low profile holder or case is provided for the hair curler rollers.

4 Claims, 3 Drawing Sheets

HAIR CURLER ROLLER

This application is a continuation of application Ser. No. 361,509 filed 6/5/88 now abandoned.

The present invention relates to a hair curler roller about which hair ends can be wound and having a flexible strap attached to one end and a fastening means at the opposite end whereby the strap can be pulled over the hair ends thereof, and fastened to the fastening means on the other end of the roller body.

BACKGROUND OF THE INVENTION

Roller type hair curlers are known, and in my previous U.S. Pat. No. 4,572,221, a soft roller hair curler is shown in which the roller body is flexible and is provided with a short strap portion having an end cap for insertion upon the opposite end of the roller body. The present invention, on the other hand, utilizes a hair curler roller having a center core of rigid material, and a flexible outer sleeve. An elongated strap having an end loop portion is provided in which the strap portion can be retracted substantially within the center core, or pulled out, when in use.

SUMMARY OF THE INVENTION

It is an object of the present invention to provide a roller type hair curler having a rigid center core and a flexible outer sleeve together with an elongated strap adapted to be pulled over the outer sleeve after hair has been wound around the sleeve, and thereafter permitting the strap to be returned to its linear condition, when released.

Another object of the present invention is to provide a hair curler roller body having a rigid center core and a rigid end cap at the end of the center core remote from the strap.

It is a further object of the present invention to provide a roller hair curler with a retractable strap so that the overall dimensions of the hair curler in the retracted position is such that a carrying case for a group of roller hair curlers can be reduced in overall height, making it easier for transportation, as well as for the easy and rapid utilization of the hair curlers.

It is a further object of the present invention to provide a ribbed, rigid core for hair curler rollers having a silicone sealant covering.

A further object of the present invention is to provide a hair curler of another configuration, such as a triangular shape for the creation of zig-zag curls, or the like.

It should be apparent that the present roller hair curler unit can be made of a flexible outer sleeve on a plastic or aluminum center rigid core in which the strap can be inserted and retained within the interior of the core, or pulled out when it is desirable to employ the roller for curling the hair.

BRIEF DESCRIPTION OF THE DRAWINGS

In order that the invention will be more clearly understood, it will now be disclosed in greater detail with reference to the accompanying drawings, in which.

DESCRIPTION OF THE PREFERRED EMBODIMENTS

Figure 1:
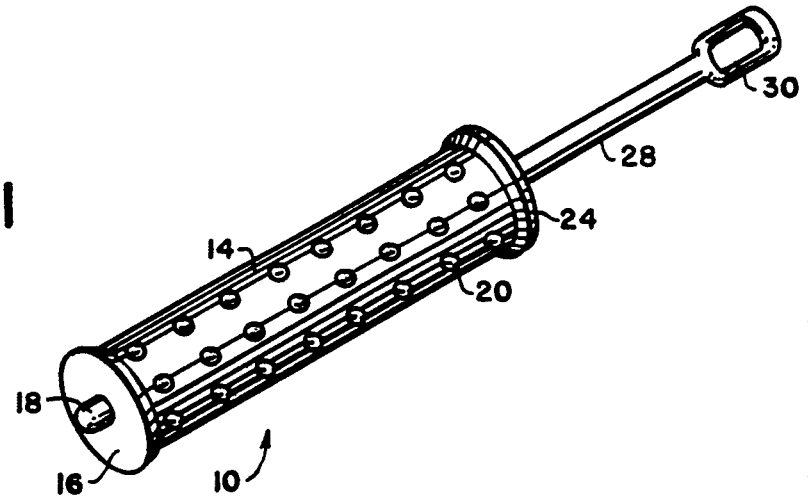
FIG. 1 is a perspective view of the roller hair curler constructed in accordance with the teachings of my invention.
Figure 2:
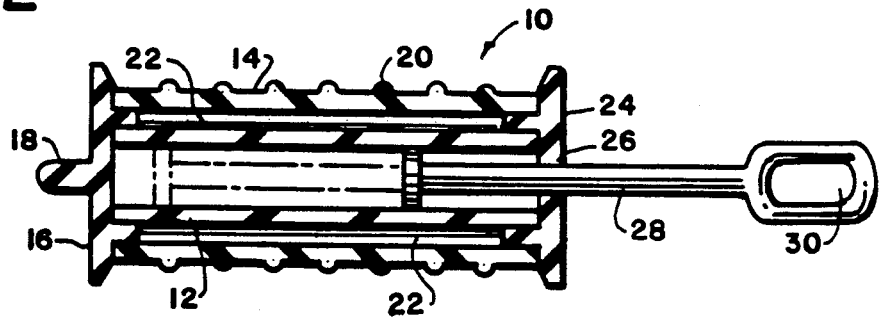
FIG. 2 is a longitudinal sectional view thereof.
Figure 3:
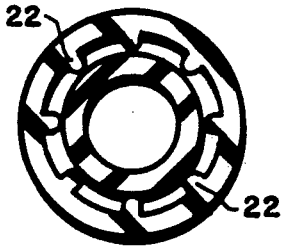
FIG. 3 is a cross sectional view thereof.

Referring to FIGS. 1–3, a roller hair curler referred to generally by the reference numeral 10 is provided with a cylindrical rigid inner hollow center core 12, preferably fabricated of plastic or aluminum, and a flexible cylindrical outer sleeve 14. The rigid inner core is provided at one end with a disc-like end cap 16 having a center post 18. The outer sleeve 14 is provided with a slightly roughened outer surface have spaced shallow elevations 20 and spaced ribs 22 on the inner surface thereof. A detachable other end cap 24 is also disc-shaped but is provided with a central hole 26. A flexible, elongated strap 28 is loosely held within the hole and is movable within and without the hollow center core 12 as seen in full and dotted lines in FIG. 2. The end loop 30 can be pulled out for use and the hair ends looped about the roller outer sleeve 14 while the flexible strap 28 is stretched over the hair ends and the end loop 30 is circled around the post 18.

Figure 4:
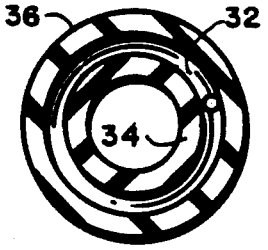
FIG. 4 is a sectional view of an alternate embodiment of the present invention.

As seen in FIG. 4, an alternate embodiment of the present invention is shown having a coiled wire inner spring 32 between a rigid plastic or aluminum hollow center core 34 and a flexible outer sleeve 36 of silicone, or the like.

Figure 5:
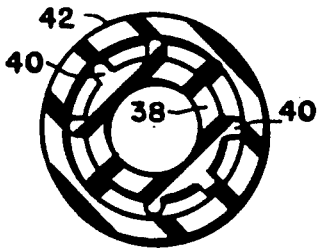
FIG. 5 is a cross sectional view of a further embodiment of the present invention.

In FIG. 5 a further embodiment is shown having a rigid hollow cylindrical center core 38 provided with a plurality of spaced peripheral protuberences 40, and a spaced flexible outer sleeve 42.

Figure 6:
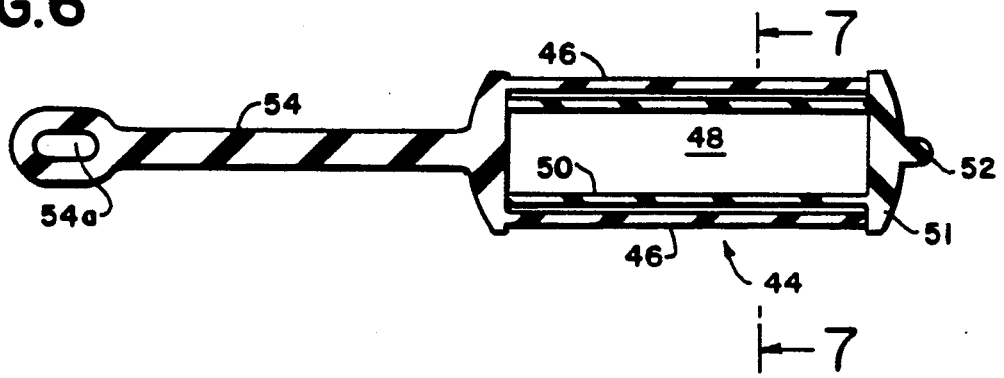
FIG. 6 is a longitudinal sectional view of another embodiment of the present invention.
Figure 7:
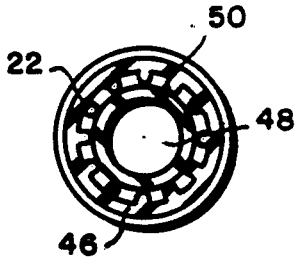
FIG. 7 is a sectional view of the hair curler shown in FIG. 6.

Referring to FIGS. 6 and 7, a roller hair curler is shown referred to generally by the numeral 44 having a flexible cylindrical hollow outer sleeve 46 open at end 48. An inner rigid hollow core 50 is inserted through the open end 48 and is provided with an integral end cap 51 having a central post 52. The outer sleeve 46 also has an integral flexible strap 54 which is adapted to be pulled over the hair curler body with hair ends between the outer sleeve 46 and an inner surface of strap 65, and the latter secured by placing the hole **54*a* in the strap over the post 52**.

Figure 8:
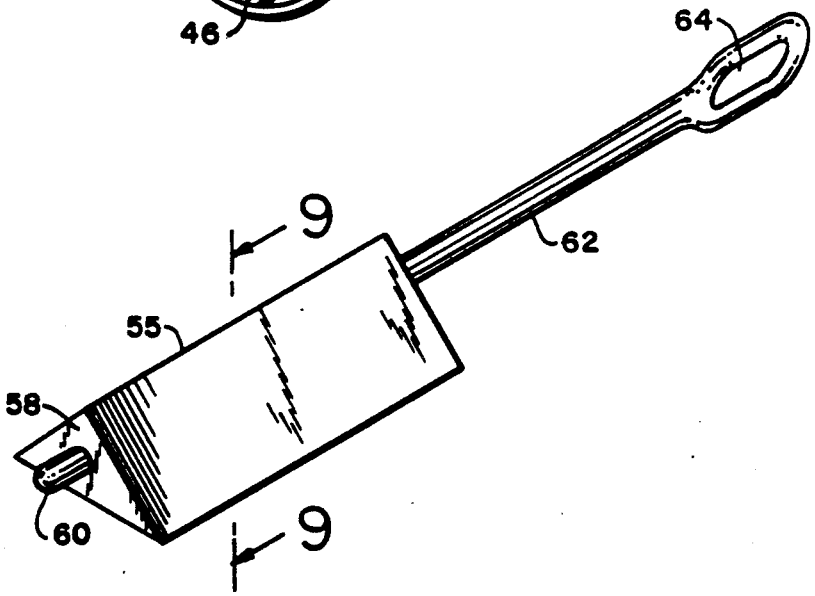
FIG. 8 is a perspective view of a further embodiment of the present invention.
Figure 9:
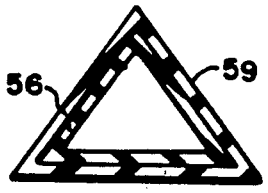
FIG. 9 is a sectional view of the embodiment of the invention shown in FIG. 8.

FIGS. 8 and 9 show an alternate embodiment of my hair curler roller shown in FIG. 6 in which the roller is provided with a triangular shaped hollow outer flexible sleeve 59 and a correspondingly shaped triangular inner rigid hollow inner core 56. The hollow inner core 56 is provided at one end with an integral cap 58 having a centrally located post 60. The opposite end of outer sleeve 59 is provided with a flexible strap 62 having an end loop 64 which can be pulled over the outer sleeve of the hair curler roller with hair ends between the outer sleeve and the strap and the end loop 64 inserted over the post 60 to thereby create zig-zag curls.

Figure 10:
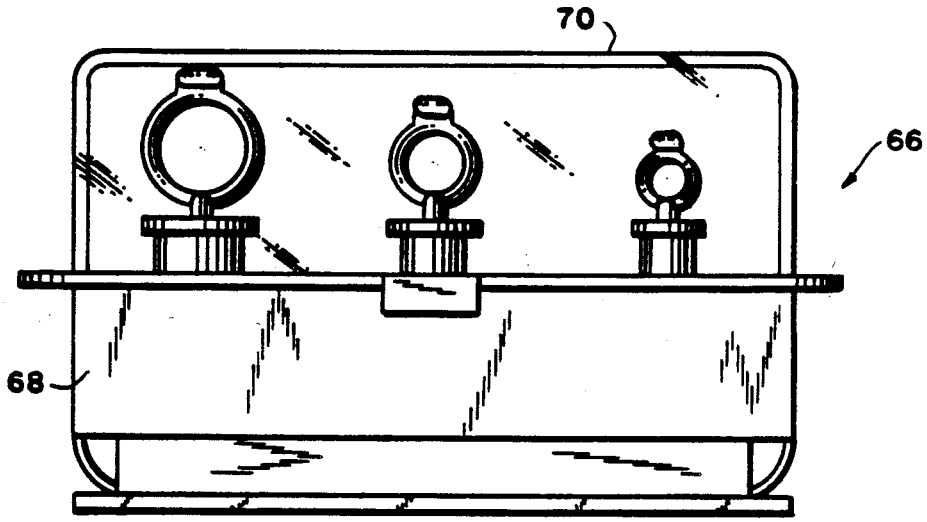
FIG. 10 is a side elevational view, partly in section, showing the carrying case for hair roller curlers.
Figure 11:
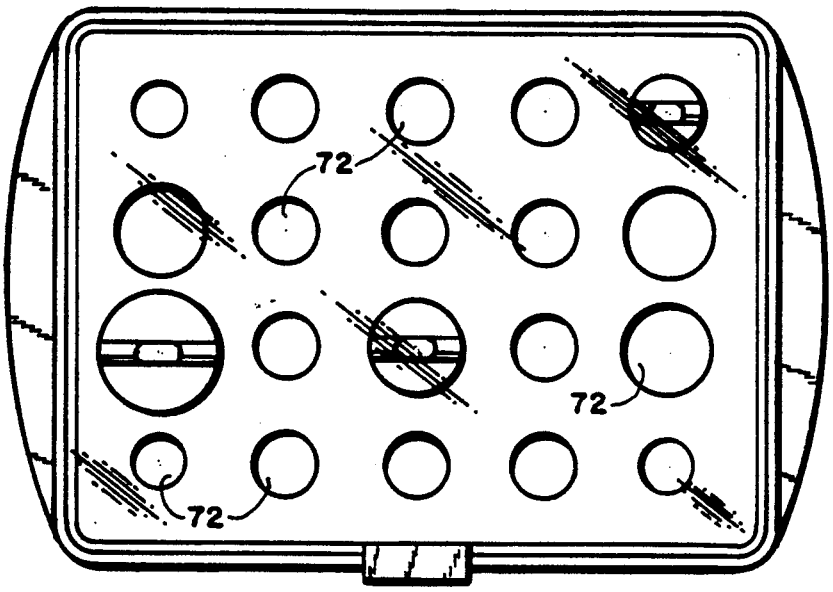
FIG. 11 is a top plan view of the view shown in FIG. 10.

Referring now to FIGS. 10 and 11, a compact holder or case for the hair curler roller shown in FIGS. 1 and 2 is referred to generally by the reference numeral 66 having an opaque base 68 and a hinged transparent cover 70. The base 68 has a plurality of openings 72 having diameters corresponding to the diameters of the smaller or larger types of hair curlers. In addition, the base 68 is provided with a suitable heater (not shown) for applying heat to the rollers in the openings 72 when current is supplied to the heater.

Since each of the roller hair curlers 10 are provided with a retractable strap 28, the latter can be fully inserted within the rigid hollow core 12, as seen in dotted lines in FIG. 2, and again in FIG. 10, so that the overall height of the case 66 is considerably reduced, thereby resulting in a compact holder or case that can be easily packed and transported in small hand luggage, as well as stored in a bathroom or boudoir.

While the invention has been disclosed and described herein with reference to a certain number of embodiments, it is apparent that variations and modifications may be made which will fall within the true spirit and scope of the invention, as defined in the following claims:

I claim:

1. A hair curler roller comprising a flexible hollow outer sleeve, a rigid hollow inner center core, said core being provided at one end with a first end cap having a post, a second end cap at the other end of the core having a centrally located aperture, an elongated flexible strap provided with a loop at its free end and a slidable stop member at the opposite end thereof, said strap being freely movable in an unstretched condition out of said hollow center core and retractable in an unstretched condition in the hollow center core and adapted to be stretched when pulled out of said center core and over said outer sleeve in its linear condition when said stop member engages an inner end surface of said second end cap after the hair has been wound around said outer sleeve, said loop being placed over said post to thereby capture said hair between said sleeve and said strap, and said sleeve having spaced projections on the inner surface thereof extending toward the central axis of said sleeve.

2. A hair curler roller as claimed in claim 1 wherein the outer surface of the sleeve is slightly roughened by having spaced shallow elevations.

3. A hair curler roller as claimed in claim 1 wherein both said outer sleeve and said center core are cylindrical.

4. A hair curler comprising a triangular-shaped outer sleeve, a rigid inner hollow triangular-shaped core of lesser diameter than the outer sleeve and inserted within said outer sleeve, a first end cap at one end of said core having a centrally located aperture, an elongated flexible strap provided with an end loop at its free end and a slidable stop member at the opposite end thereof, a second end cap at the opposite end of said core having a post thereon, said strap being freely movable in an unstretched condition out of said hollow triangular-shaped core retractable in an unstretched condition in said core and being adapted to be slightly stretched when pulled over said outer sleeve in its linear condition when said stop member engages an inner end surface of said first end cap after the hair had been wound around said sleeve, said loop being placed over said post to thereby capture said hair between said sleeve and said strap, and said sleeve having spaced projections on the inner surface thereof extending toward the central axis of said sleeve.

* * * * *